United States Patent [19]

Kamath

[11] Patent Number: 4,465,135

[45] Date of Patent: Aug. 14, 1984

[54] FIRE FLOOD METHOD FOR RECOVERING PETROLEUM FROM OIL RESERVOIRS OF LOW PERMEABILITY AND TEMPERATURE

[75] Inventor: Krishna Kamath, Chicago, Ill.

[73] Assignee: The United States of America as represented by the United States Department of Energy, Washington, D.C.

[21] Appl. No.: 491,133

[22] Filed: May 3, 1983

[51] Int. Cl.[3] ..... E21B 43/243

[52] U.S. Cl. ..... 166/261; 166/256

[58] Field of Search ..... 166/256, 261, 266, 267, 166/272

[56] References Cited

U.S. PATENT DOCUMENTS

| | | | |
|---|---|---|---|
| 3,072,185 | 1/1963 | Bond et al. | 166/261 |
| 3,174,543 | 3/1965 | Sharp et al. | 166/261 X |
| 3,182,721 | 5/1965 | Hardy | 166/256 |
| 3,208,519 | 9/1965 | Moore | 166/261 |
| 3,452,816 | 7/1969 | Hardy et al. | 166/256 |
| 3,825,066 | 7/1974 | Redford | 166/261 |
| 3,964,545 | 6/1976 | Speller, Jr. | 166/256 |
| 3,978,925 | 9/1976 | Redford | 166/261 |
| 4,026,357 | 5/1977 | Redford | 166/261 |
| 4,252,191 | 2/1981 | Pusch et al. | 166/261 |
| 4,418,751 | 12/1983 | Emery | 166/261 |

OTHER PUBLICATIONS

"Secondary and Tertiary Oil Recovery Processes", Interstate Oil Compact Commission, 1974, pp. 94, 111 and 112.

"Enhanced Oil Recovery Via Oxygen-Enriched In Situ Combustion: Test Results from the Forest Hill Field in Texas" SPE Paper No. 11218, 1978.

"Fluid Dynamics During an Underground Combustion Process," *Petroleum Transactions,* Aime, 1958, vol. 213, pp. 146-154.

Craig, Jr., F. F. et al., "A Multipilot Evaluation of the COFCAW Process", *Journal of Petroleum Technology,* Jun. 1974, pp. 659-666.

*Primary Examiner*—George A. Suchfield

*Attorney, Agent, or Firm*—Earl L. Larcher; Stephen D. Hamel; Michael F. Esposito

[57] ABSTRACT

The present invention is directed to a method of enhanced oil recovery by fire flooding petroleum reservoirs characterized by a temperature of less than the critical temperature of carbon dioxide, a pore pressure greater than the saturated vapor pressure of carbon dioxide at said temperature (87.7° F. at 1070 psia), and a permeability in the range of about 20 to 100 millidarcies. The in situ combustion of petroleum in the reservoir is provided by injecting into the reservoir a combustion supporting medium consisting essentially of oxygen, ozone, or a combination thereof. The heat of combustion and the products of this combustion which consist essentially of gaseous carbon dioxide and water vapor sufficiently decrease the viscosity of oil adjacent to fire front to form an oil bank which moves through the reservoir towards a recovery well ahead of the fire front. The gaseous carbon dioxide and the water vapor are driven into the reservoir ahead of the fire front by pressure at the injection well. As the gaseous carbon dioxide cools to less than about 88° F. it is converted to liquid which is dissolved in the oil bank for further increasing the mobility thereof. By using essentially pure oxygen, ozone, or a combination thereof as the combustion supporting medium in these reservoirs the permeability requirements of the reservoirs are significantly decreased since the liquid carbon dioxide requires substantially less voidage volume than that required for gaseous combustion products.

5 Claims, No Drawings

FIRE FLOOD METHOD FOR RECOVERING PETROLEUM FROM OIL RESERVOIRS OF LOW PERMEABILITY AND TEMPERATURE

BACKGROUND OF THE INVENTION

The present invention relates generally to enhanced oil recovery techniques employing in situ combustion or fire flooding, and more particularly to such recovery of petroleum from subterranean oil reservoirs characterized by relatively low permeability and temperatures wherein oxygen, ozone or a combination thereof is utilized as the combustion supporting medium for the in situ combustion.

Enhanced oil recovery procedures are utilized in various reservoir flooding and treatment programs for recovering oil from reservoirs which have previously been pressure depleted and sometimes subsequently water flooded. Fire flooding is receiving increased interest as a viable enhanced oil recovery technique. Fire flooding is practiced by injecting compressed air into an injection well and igniting the petroleum in the reservoir surrounding the injection well to establish a combustion zone or fire front. This fire front propagates into the reservoir in a radially expanding manner away from the injection well. The heat of combustion decreases the viscosity of the oil in the reservoir immediately in front of the fire front and together with the pressure of the injected air, continually forces the oil to a location in the reservoir ahead of the moving fire front. Some of the heavier petroleum components remain in the reservoir so as to provide the fuel required for the combustion process. The combustion of the petroleum in the presence of the compressed air provides a considerable quantity of water vapor which together with the gaseous carbon dioxide and nitrogen are forced into the reservoir to displace the oil reduced in viscosity away from the fire front into the reservoir. The hot water vapor and the hot gaseous products also act with the heat of combustion to reduce the viscosity of the oil in the reservoir near the fire front. The temperature of the reservoir ahead of the combustion front declines rapidly to the ambient reservoir temperature, so as to cool the warmed oil and increase the viscosity thereof which substantially decreases the mobility of the oil. This action forms a region in the reservoir containing mobile phases of oil and gas that is referred to as an oil bank. By maintaining a constant injection pressure, the fire front propagates through the reservoir and forms a plurality of mobile regions. The region nearest the fire front is formed of three phases, gases, oil and water which may be residual water in the reservoir as well as the water formed during combustion. The second region immediately removed from the first and further away from the fire front is formed of two phases with the oil and gas and provides an oil bank with the water in the first region acting as pusher or piston for moving the oil and gas through the oil formation. As the fluids are displaced from the combustion front into cooler zones in the reservoir and the mobility of the liquids decrease, there is an increase in liquid saturation which increases the resistance to gas flow from the fire front through the reservoir.

Historically, fire flooding procedures have been practiced in reservoirs which have relatively high permeabilities of greater than about 100 millidarcies (md). It was found that this relatively high permeability value is necessary for the successful practice of the in situ combustion process due to the large volumes of compressed air required to sustain the underground fire front and for venting the resulting gaseous combustion products through the reservoir. In a conventional fire flood, the fire front radially expands from the injection well to several hundred feet depending upon the spacing between the injection well and the producer well or wells. Normally, the width or height of the fire front seldom exceeds about ten feet, again depending upon the thickness of the reservoir being fire flooded. The temperature profile over the length of the fire front levels off to ambient reservoir temperatures at locations a short distance, e.g., about 24 inches, in front of the fire front. The fire front decreases the viscosity of a substantial amount of petroleum in the reservoir and under steady-state conditions forms the aforementioned oil bank which is a region of constant saturation within the rock matrix with the oil bank growing at a rate proportional to saturation.

While fire flooding techniques using compressed air have shown some success, considerable problems and difficulties are encountered such as the large volume of injected compressed air required to sustain the in situ combustion process and the large volume of nitrogen present in the combustion products which does not attribute to the recovery procedure and yet must be forced through the reservoir in order to provide for successful recovery of petroleum. Efforts to overcome these and other problems associated with using compressed air have been somewhat alleviated by employing oxygen-enriched air or pure oxygen as the combustion supporting medium. The use of oxygen requires that the materials utilized in the injection well be compatible with oxygen so as to prevent the destruction of these materials by corrosion or combustion. By employing oxygen as the combustion supporting medium only about one-fifth as much volume is required for the injection process as compared to compressed air since nitrogen which accounts for about 80% of the volume of the compressed air is eliminated. Thus, the use of the pure oxygen in the process instead of air not only drastically reduces the volume of the combustion supporting medium required but also provides a decrease in the fluid volume following combustion which generally increases the injectivity of the reservoir matrix in the combustion zone. Further, by utilizing pure oxygen as the combustion supporting medium, lower injection pressures can be used with greater well spacings. Another advantage realized by oxygen is that carbon dioxide is essentially the only gaseous product produced during the combustion process. This gaseous carbon dioxide is highly soluble in crude oil and promotes the swelling of the crude oil to enhance the reduction in the viscosity thereof for increasing the mobility of the oil through the reservoir. The gaseous carbon dioxide produced at the burn front will flow through a reservoir once the oil and water between the oil bank and the producing well have been saturated.

While oxygen has been used as the combustion supporting medium and has shown to provide many advantages over the use of compressed air in fire flooding processes, fire floods have been historically limited to use in reservoirs of relatively high permeability due to the relatively large volume of gaseous $CO_2$ produced in the combustion process even though this volume is only about one-fifth of the volume of the gaseous combustion products produced when using compressed air. The high permeability of the reservoir is required of reservoirs having ambient temperatures greater than about 88° F. since even though the volume of gaseous $CO_2$ is considerably less than that of the gaseous combustion products using compressed air, the permeability of the reservoir must be sufficient to allow for the gaseous $CO_2$ to be displaced through the reservoir formation ahead of the fire front. Fire floods have not been shown to be a practical recovery process in reservoirs of low permeability, i.e., less than about 100 md, where the reservoir temperatures arc less than about 88° F., especially the relatively cold (60°–75° F.) and low permeability (about 20 md) reservoirs such as in the Appalachian region.

SUMMARY OF THE INVENTION

Applicant has discovered that a significant advantage to the use of the in situ combustion or fire flooding process can be realized in reservoirs having ambient temperatures less than about 88° F. and permeabilities less than about 100 (md) by using oxygen of at least 98% pure as the combustion supporting medium. The signficant advantage derived from the present invention is due to the fact that at a temperatures less than about 88° F. and at a pore pressure greater than the saturated vapor pressure of carbon dioxide at said temperature, the carbon dioxide is a liquid. With the carbon dioxide in liquid form, the permeability requirements of the reservoir are significantly less than that heretofore thought useable. The combustion of the oxygen produces water vapor and gaseous $CO_2$ which are driven from the fire front into the formation where they encounter the relatively cold reservoir material which condenses the water vapor and rapidly cools the gaseous $CO_2$ to a temperature below 88° F. so as to convert it to liquid form. With the $CO_2$ in liquid form significantly less open permeability is required in the formation for receiving the liquid than would be required for gaseous $CO_2$ as would occur in warmer reservoir formations.

In such low temperature reservoirs under an oxygen-fed fire flood, the produced carbon dioxide converts to a liquid a short distance from the leading edge of the fire front and dissolves in the oil and partially in the water until saturation. The low viscosity of the liquid carbon dioxide (0.05 to 0.1 cp) promotes its solution in oil which, in turn, decreases the viscosity of the oil to significantly enhance the mobility of the oil through the reservoir formation.

Accordingly, it is the primary aim or objective of the present invention to provide a method for effecting the recovery of petroleum from relatively tight oil reservoirs exhibiting permeabilities less than about 100 (md) when the reservoir is at a temperature less than the critical temperature of carbon dioxide, i.e., about 88° F., at a pore pressure of at least 1070 psia or more specifically, at a pressure exceeding the saturated vapor pressure of carbon dioxide at the temperature of the oil reservoir. In such reservoirs, which are the predominant type reservoirs in the Appalachian region where the temperature range from about 60°–75° F., the permeability of the formation is in the range of about 20–100 md which is significantly tighter than that of reservoirs previously subjected to fire flooding. The practice of the method of the present invention for recovering petroleum from a subterranean reservoir characterized by relatively low permeability at a temperature less than about 88° F. at a pore pressures greater than the saturated vapor pressure of carbon dioxide at the temperature is achieved by injecting a combustion supporting medium consisting essentially of oxygen or ozone or a combination thereof into an injection well bore penetrating the reservoir. Combustion of the petroleum in the reservoir contiguous to the well hole is initiated in the presence of the combustion supporting medium to provide a radially expanding fire front. The heat of combustion and the hot combustion products sufficiently increases the mobility of the petroleum in the reservoir adjacent to the fire front to form a radially expanding oil bank in the reservoir ahead of the fire front. The combustion of the oxygen provides combustion products consisting essentially of gaseous carbon dioxide and water vapor. By maintaining a sufficient injection pressure in the well, the gaseous combustion products are driven ahead of the fire front into the oil bank where the pressure and the temperature of the reservoir are adequate to liquify the gaseous carbon dioxide which dissolves in the petroleum in the reservoir and further decreases the viscosity thereof so as to significantly increase the mobility of petroleum through the reservoir. The petroleum may then be recovered from the reservoir through at least one other well bore penetrating the reservoir at a location spaced from the injection well bore.

By using oxygen or ozone or a combination thereof as the combustion supporting medium, the gaseous products of combustion consists essentially of carbon dioxide which liquifies in the reservoir immediately in front of the fire front to significantly decrease the permeability requirements heretofore deemed necessary for fire flooding operations. Another advantage of the present invention is that carbon dioxide may be recovered along with the petroleum so as to provide a source of carbon dioxide useful in other processes. For example, the excess carbon dioxide may be injected into the reservoir through the injector well periodically or along with the oxygen so as to further increase the saturation of the oil bank and enhance the piston-like displacement of the oil through the system. This piston-like displacement provided by the liquid $CO_2$ and the water is a two-phase flow, i.e., water and petroleum, so as to provide for the displacement of the oil through the reservoir in a manner similar to a micellar flood.

Other and further objects of the invention will be obvious upon an understanding of the illustrative method about to be described or will be indicated in the appended claims, and various advantages not referred to herein will occur to one skilled in the art upon employment of the invention in practice.

DETAILED DESCRIPTION OF THE INVENTION

Some petroleum reservoirs in the United States such as those in the Appalachian region contain considerable amounts of petroleum previously thought to be unrecoverable. These oil reservoirs are at relatively low temperature in the range of about 60°–75° F., contain high gravity oil and are of permeabilities in the range of about 20–100 md. Also, these oil reservoirs have normally been subjected to conventional pressure depletion and water flooding. Various efforts to recover the remaining oil such as by micellar flooding and the like have not proven to be satisfactory. The present invention provides a satisfactory method for effecting the recovery of a substantial percentage of this heretofore unrecoverable oil.

In accordance with the present invention, in situ combustion or fire flooding is utilized to drive the oil through the reservoir to one or more recovery or producer wells. This in situ combustion can be visualized as a linear system extending from the injection well to the producing well. Ignition of the petroleum and pure oxygen, ozone, or combinations thereof at the injection well can be achieved by using a thermite bomb, charcoal or the like. As the resulting fire front expands radially outwardly from the injection well, the heat of combustion and the hot combustion products vaporizes a substantial percentage of the oil in the reservoir immediately ahead of the fire front with this oil and the combustion products being displaced into the reservoir by the pressure at the injection well. Products of combustion resulting from the use of oxygen, ozone, or combinations thereof are virtually entirely made up of water vapor and gaseous $CO_2$. As these products of combustion are displaced through the formation from the fire front, they encounter colder regions of the reservoir immediately ahead of the fire front which effects the condensation of the water and the liquefaction of the $CO_2$ when the reservoir or pore pressure is greater than the saturated vapor pressure of the $CO_2$ at the reservoir temperature. The saturated vapor pressure of carbon dioxide at ambient reservoir temperature is less than 1070 psia with reservoirs colder than about 88° F. For example, the saturated vapor pressure is 909 psia at 75° F. and 746 psia at 60° F. With this conversion of the gaseous products of combustion to liquid a significant reduction in the permeability requirements of the reservoir is realized. Thus, the subject invention is particularly applicable to reservoirs of low permeability wherein the reservoir temperatures are less than the critical temperature of $CO_2$ which is approximately 88° F. (87.7° F.) at a pore pressure of 1070 psia. Inasmuch as various reservoirs containing this recoverable oil in the Appalachian region are at depths greater than 1000 feet, the pressure requirements for the liquification of gaseous $CO_2$ are easily realized.

The physical state of carbon dioxide in reservoir conditions meeting the aforementioned requirements is in liquid form. At temperatures less than about 88° F. and at pressures between atmospheric and 1070, the carbon dioxide exists as a vapor and liquid with the liquid percentage increasing as the pore pressure nears the 1070 psia level while at any pressure greater than 1070 psia the $CO_2$ exists solely as a liquid. In the low temperature reservoirs of low permeability under fire flooding, the produced carbon dioxide converts to a liquid a short distance from the leading edge of the fire front and tends to dissolve in the oil and partially in water until saturation. The low viscosity of liquid carbon dioxide promotes its solution in oil and apparently remains as a continuous phase, extraneous to the oil so as to flow towards the production well under existing pressure gradients. The produced carbon dioxide tends to remain associated with the oil in solution. As a result of this condition, the less viscous oil containing dissolved carbon dioxide is provided with a higher mobility that would tend to increase the oil saturation in the segment of the oil bank immediately ahead of the fire front in order to satisfy the condition of a piston-like displacement. Thus, there is a carbon dioxide concentration gradient in the direction of flow from the injection well to the producer well. These concentrations of carbon dioxide in the oil bank tend to enlarge the oil bank as it becomes saturated toward the producing well so that as the oil bank is established near the fire front it gradually increases in size. Thus, as the fire front pushes the oil bank toward the producer well, the oil bank also increases in size at a rate greater than that provided by the fire front so as to enable the oil to be recovered from the oil bank for a considerable period of time prior to the fire front reaching the producer well.

The injection of ozonized oxygen instead of pure oxygen through a fire flood provides a mechanism for increasing the active injectivity of a tight reservoir. Inasmuch as one volume of ozone is equal to 1.5 units of oxygen, a smaller volume of ozone would be required to burn a given amount of oil. Since ozone is more chemically reactive than oxygen, ozone may promote a more effective combustion of many crude oils including the "Penn Grade" oils known for their relatively poor burning characteristics.

In a typical comparison, the fire flooding of a reservoir having a temperature less than 88° F. is compared to a reservoir of greater than 88° F. as set forth in the Table below.

TABLE

Voidage (Volume Decrease) Associated with Fire Flooding with Pure Oxygen
Chemical Reaction: (Gram/Milliliter Units/Mole)

| | $[CH_2] + 1.5\ O_2$ | | $CO_2 + H_2O$ | |
|---|---|---|---|---|
| | 14 | 48 | 64 | 18 |
| <88° F. | (L) | (g) | (L) | (L) |
| >88° F. | (L) | (g) | (g) | (L) |

| Volume (ml) @ Pressure (psia) | $[CH_2]$ | $O_2$ | $CO_2$ | $H_2O$ | v | v/17.5 |
|---|---|---|---|---|---|---|
| | | Temperature <88° F. | | | | |
| 14.7 | 17.5 | 33,600 | 64 | 18 | 33,536 | 1916 |
| 2,000 | 17.5 | 247 | 64 | 18 | 183 | 10.5 |
| 3,000 | 17.5 | 165 | 64 | 18 | 101 | 5.8 |
| | | Temperature >88° F. | | | | |
| 14.7 | 17.5 | 33,600 | 22,400 | 18 | 11,200 | 648 |
| 2,000 | 17.5 | 247 | 165 | 18 | 82.5 | 4.7 |
| 3,000 | 17.5 | 165 | 110 | 18 | 55 | 3.1 |

As shown in the Table, the calculations are provided for atmospheric pressure, 2,000 psia and 3,000 psia. The latter pressures correspond to pressure encountered at normal depths of 2,000 to 3,000 feet, typical of most oil reservoirs including those in the Appalachian region. The net change in volume (decrease) assuming complete combustion of the oil remaining in the reservoir and the ratio of this change in volume to the volume of oil burn is given in the last column of the Table. It can be readily seen from this Table that the volume changes that occur within the low-temperature reservoirs are far more significant when the combustion products are all liquifiable in the reservoir. The affect of increased voidage rate or volume decreases in the fire flood operation is to increase the effective permeability of the burned out reservoir portion which condition is particularly important in the fire flooding of relatively low permeability reservoirs since it provides void volume necessary for the injectivity of the combustion supporting medium through the reservoir to the fire front.

The water produced in the fire flood serves as a carrier of waste heat from the fire front and beyond where it warms up the reservoir fluid. The gaseous $CO_2$ as it enters the reservoir also loses a considerable amount of heat during liquefaction. These liquids decrease the fuel requirements of the fire flood and significantly increase the mobility of oil in the reservoir to provide a shorter flood life. This flooding mechanism can be enhanced by injecting carbon dioxide into the fire zone in the form of a single or intermittant slug with or without additional water so as to carry additional energy from the fire front in the form of sensible heat to further increase the mobility of the fluids within the reservoir.

The quantity of oxygen or ozone injected into the reservoir to sustain combustion depends upon the characteristics and the quantity of petroleum contained in the reservoir. In most formations about 0.8 to 1.0 standard cubic feet of oxygen per hour per square foot of burning surface would be adequate to sustain the combustion processes necessary to provide a viable fire front.

It will be seen that the present invention provides a method for providing enhanced oil recovery by fire flooding for a relatively large number of oil reservoirs in the United States which until now were not expected to be successfully fire-flooded due to low or inadequate reservoir permeability.

What is claimed is:

1. A method for recovering petroleum from a subterranean reservoir characterized by relatively low permeability, a temperature of less than the critical temperature of carbon dioxide, and a pore pressure greater than the saturated vapor pressure of carbon dioxide at said temperature, comprising the steps of injecting a combustion supporting medium consisting essentially of oxygen or ozone or a combination thereof into a borehole penetrating the reservoir, initiating combustion of petroleum in the reservoir contiguous to the borehole in the presence of the combustion supporting medium to provide combustion products consisting essentially of gaseous carbon dioxide and water vapor and a radially expanding fire front which together sufficiently increase the mobility of petroleum in the reservoir adjacent to the fire front to form a radially expanding oil bank in the reservoir ahead of the fire front, maintaining a sufficient pressure in the borehole to drive the combustion products ahead of the fire front into the oil bank where the water vapor condenses and the pressure in and temperature of the reservoir are adequate to liquify the gaseous carbon dioxide which dissolves in the petroleum in the reservoir and decreases the viscosity thereof for substantially increasing the mobility of the petroleum in the reservoir beyond the level provided by the heat of combustion and water, and recovering the petroleum from the reservoir through at least one other borehole penetrating the reservoir at a location spaced from the first-mentioned borehole.

2. The method claimed in claim 1, wherein the reservoir has a permeability in the range of about 20 to 100 millidarcies.

3. The method claimed in claim 2, wherein the reservoir is at a temperature in the range of about 60° to 75° F.

4. The method claimed in claim 1, wherein the oxygen or ozone is of a purity of at least 98 percent.

5. The method claimed in claim 1, including the additional step of injecting at least one time an adequate volume of at least one of carbon dioxide and water into the first-mentioned borehole together with the combustion supporting medium for displacing additional heat from the fire front into the reservoir and for enhancing the mobility of the petroleum in the oil bank.

* * * * *